US006705253B2

(12) United States Patent
Lesniak

(10) Patent No.: US 6,705,253 B2
(45) Date of Patent: Mar. 16, 2004

(54) ELECTRONIC CONTROLLED EMISSION AND FLUID INJECTION SYSTEM FOR AN INTERNAL COMBUSTION ENGINE

(76) Inventor: Edward J. Lesniak, 1516 Lebenta St., Novi, MI (US) 48377

( * ) Notice: Subject to any disclaimer, the term of this patent is extended or adjusted under 35 U.S.C. 154(b) by 0 days.

(21) Appl. No.: 10/094,850

(22) Filed: Mar. 11, 2002

(65) Prior Publication Data

US 2003/0168025 A1 Sep. 11, 2003

(51) Int. Cl.[7] ..... F02B 47/00
(52) U.S. Cl. ..... 123/25 A; 123/25 J
(58) Field of Search ..... 123/25 R, 25 A, 123/25 B, 25 C, 25 D, 25 E, 25 F, 25 P, 25 Q

(56) References Cited

U.S. PATENT DOCUMENTS

| | | | | |
|---|---|---|---|---|
| 2,431,679 A | | 12/1947 | Adair | 123/25 |
| 2,611,592 A | | 9/1952 | Anderson | 261/18 |
| 3,490,422 A | | 1/1970 | Bullis | 123/25 |
| 3,528,225 A | | 9/1970 | Manfredi | 55/258 |
| 3,778,039 A | | 12/1973 | Dore | 261/18 A |
| 3,842,808 A | | 10/1974 | Cataldo | 123/25 P |
| 3,991,724 A | | 11/1976 | Geiser | 123/25 R |
| 4,046,119 A | | 9/1977 | Perry | 123/119 A |
| 4,048,963 A | | 9/1977 | Cottell | 123/25 R |
| 4,119,062 A | | 10/1978 | Trevaskis et al. | 123/25 R |
| 4,296,723 A | | 10/1981 | Aldrich | 123/510 |
| 4,300,484 A | | 11/1981 | Goodman | 123/25 J |
| 4,300,485 A | | 11/1981 | Goodman | 123/25 J |
| 4,306,519 A | | 12/1981 | Schoenhard | 123/25 R |
| 4,397,268 A | | 8/1983 | Brown | 123/25 L |
| 4,423,704 A | | 1/1984 | Persinger | 123/25 R |
| 4,442,802 A | | 4/1984 | Cook et al. | 123/25 L |
| 4,986,223 A | | 1/1991 | Mahoney | 123/25 B |
| 5,125,366 A | * | 6/1992 | Hobbs | 123/25 C |
| 5,148,776 A | | 9/1992 | Connor | 123/25 J |
| 5,149,466 A | | 9/1992 | Megenbier | 261/18.2 |
| 5,257,598 A | | 11/1993 | Mehr | 123/25 B |
| 5,669,334 A | | 9/1997 | Schonfeld et al. | 123/25 R |
| 5,758,606 A | | 6/1998 | Rosen et al. | 123/25 B |
| 5,823,149 A | | 10/1998 | Mezheritsky et al. | 123/25 A |
| 6,095,100 A | | 8/2000 | Hughes | 123/25 C |
| 6,112,705 A | | 9/2000 | Nakayama et al. | 123/25 C |
| 6,170,441 B1 | | 1/2001 | Haldeman et al. | 123/25 D |
| 6,196,165 B1 | | 3/2001 | Rosen et al. | 123/25 B |
| 6,230,698 B1 | | 5/2001 | Shaw | 123/572 |
| 6,240,883 B1 | | 6/2001 | Ahern et al. | 123/25 R |
| 6,273,032 B1 | | 8/2001 | Ruoff et al. | 123/25 R |
| 6,289,853 B1 | | 9/2001 | Walczak et al. | 123/25 R |
| 6,290,215 B1 | * | 9/2001 | Pinsker | 261/23.2 |
| 6,311,651 B1 | | 11/2001 | Singh | 123/25 C |
| 6,460,491 B1 | * | 10/2002 | Stanglmaier et al. | 123/25 J |
| 2002/0005177 A1 | | 1/2002 | Harvery | 123/25 R |

FOREIGN PATENT DOCUMENTS

| | | | | |
|---|---|---|---|---|
| GB | 2259326 A | * | 3/1993 | F02B/29/04 |

* cited by examiner

*Primary Examiner*—Henry C. Yuen
*Assistant Examiner*—Hyder Ali
(74) *Attorney, Agent, or Firm*—Gifford, Krass, Groh, Sprinkle, Anderson, & Citkowski, P.C.

(57) ABSTRACT

An engine fluid injection system uses a fluid rail and a tube in fluid communication with the rail to deliver a fluid to a fluid injector. The fluid injector is inserted into an internal combustion engine intake manifold. A power train control module operates to maintain a preselected fuel to fluid ratio and thereby attain superior fuel economies.

15 Claims, 5 Drawing Sheets

| | | | | | |
|---|---|---|---|---|---|
| ASD | Automatic Shut Down | FP | Fuel Pump | PDC | Power Distribution Center |
| BCM | Body Control Module | FPM | Fuel Pump Module | WI | Water Injector |
| F | Fuse | FPRC | Fuel Pump Relay Control | WLSS | Water Level Sensor Signal |
| FI | Fuel Injector | IC | Ignition Coil | WP | Water Pump |
| FLSS | Fuel Level Sensor Signal | PCM | Powertrain Control Module | WPM | Water Pump Module |

Fig. 9

FUEL / WATER / IGNITION SYSTEM FOR Fig. 3

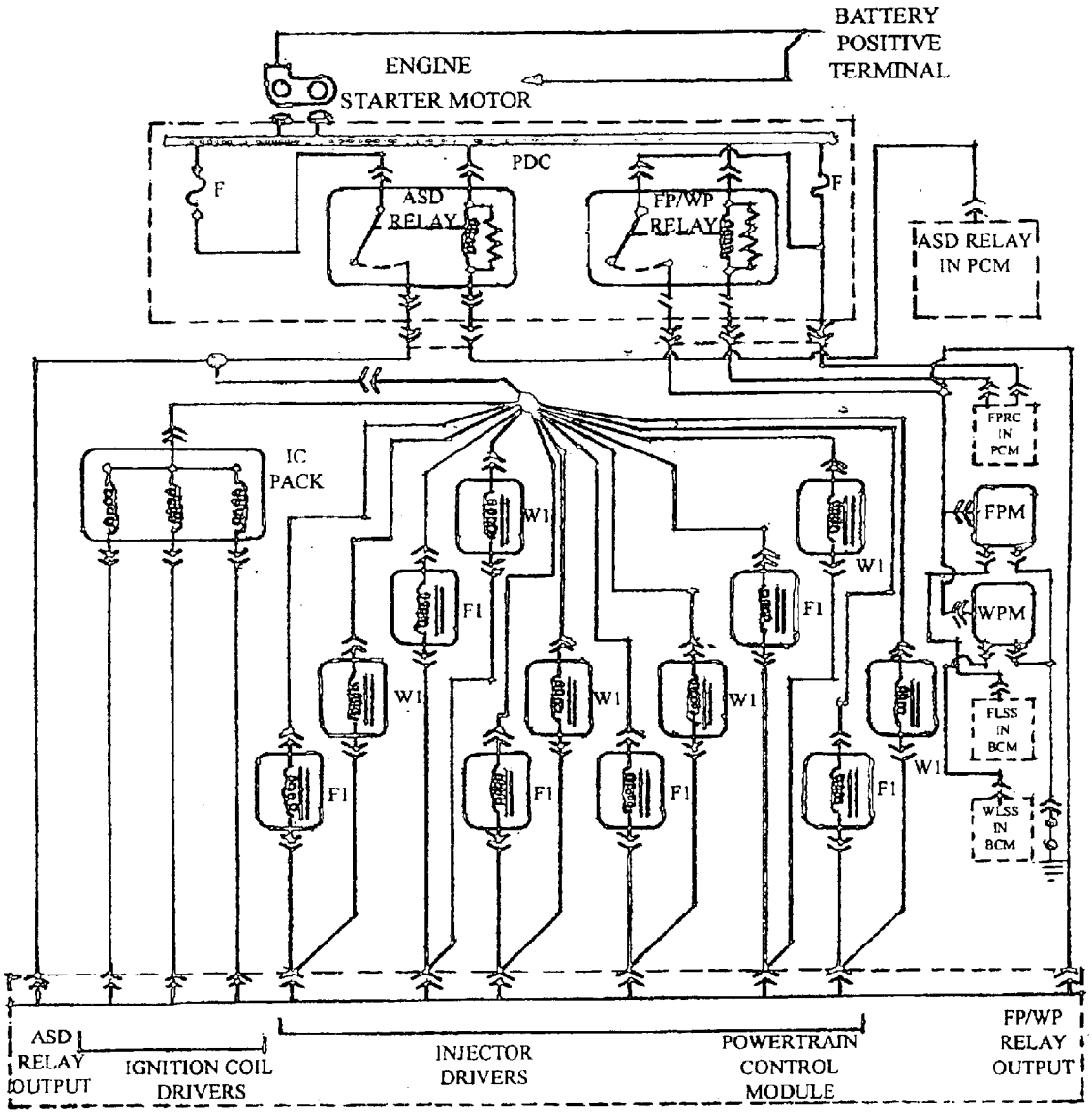

| | | | | | |
|---|---|---|---|---|---|
| ASD | Automatic Shut Down | FP | Fuel Pump | PDC | Power Distribution Center |
| BCM | Body Control Module | FPM | Fuel Pump Module | WI | Water Injector |
| F | Fuse | FPRC | Fuel Pump Relay Control | WLSS | Water Level Sensor Signal |
| FI | Fuel Injector | IC | Ignition Coil | WP | Water Pump |
| FLSS | Fuel Level Sensor Signal | PCM | Powertrain Control Module | WPM | Water Pump Module |

ELECTRONIC CONTROLLED EMISSION AND FLUID INJECTION SYSTEM FOR AN INTERNAL COMBUSTION ENGINE

FIELD OF THE INVENTION

The present invention relates to a system for electronic injection control of water or an aqueous solution into an internal combustion engine with spark ignition and with electronic controls in which the injection rate is proportional to the engine speed and engine load.

BACKGROUND OF THE INVENTION

The discharge of exhaust gases into the atmosphere by the ever-increasing number of motor vehicles in use today has significantly contributed to the contamination of our atmosphere and to the welfare of the general public. Accordingly, the federal government proposed pollution abatement legislation to at least minimize contamination of our environment.

In an effort to comply with such laws and to reduce pollution from motor vehicles, many anti-pollution devices have been developed to control the exhaust emissions. While many of these recently developed anti-pollution devices have reduced pollution to some extent, they are relatively expensive and require use of a specific kind of fuel to keep these anti-pollution devices from early deterioration and replacement thereof, adding to the cost of motor vehicle maintenance.

Also, the federal government has proposed that more efficient vehicles be produced in order to attain a 15% reduction of fuel consumption. Many methods have been tried such as adding carburetion water injection, regenerative steam or vapor into the intake air, fluids pumped directly into the engine or intake air humidifiers in which air is passed through a volume of water before being introduced into the engine have proved unsuitable for all engine speeds. These devices suffer from additional problems, since they are usually operated solely in response to engine speed, directly by the exhaust gases from the engine, or either directly or indirectly in response to engine intake manifold pressure. Although these techniques result in a fluid injection rate that may be adequate under certain engine operating conditions, such as a constant speed cruise condition, the injection rate is inadequate during other engine operating conditions such as acceleration and deceleration. When the fluid injection rate is insufficient, the beneficial effects of the fluid are not obtained. Conversely, when the fluid injection rate is too high, the surplus fluid within the combustion chamber tends to quench the combustion process and diminish engine performance. Thus, there exists a need for a fluid injection system that enhances performance of an internal combustion engine across a variety of operating conditions.

SUMMARY OF THE INVENTION

The present invention provides a system for injecting a fluid, such as water or an aqueous solution, into the air intake side of an internal combustion engine in response to the flow of air. An electronic injector introduces water or an aqueous solution to obtain a precise ratio of the injected fluid to the injected fuel.

BRIEF DESCRIPTION OF THE DRAWING

The above brief description, as well as further objects, features and advantages of the present invention, will be more fully appreciated by reference to the following detailed description of presently preferred but nonetheless illustrative embodiments in accordance with the present invention, when taken in conjunction with the accompanying drawings wherein:

FIG. 9 is a schematic of the electrical fuel/water/ignition systems for FIG. 3.

Before explaining the disclosed embodiments of the present invention in detail, it is to be understood that the invention is not limited in its application to the details of the particular arrangements shown since the invention is capable of other embodiments. Also, the terminology used herein is for the purpose of description and not of limitation.

DETAILED DESCRIPTION OF THE PREFERRED EMBODIMENTS

The water injection system of the present invention can be readily installed in new motor vehicles and/or the components forming the system can be provided as a kit for installation in used or existing motor vehicles that have spark plugs, electronic fuel injectors, power train control module (PCM) and all sensors and systems. Should the water be completely consumed and not replenished, through either inadvertence or neglect, the engine will not be damaged in any way and will perform in a conventional manner. This invention can operate with one electronic water injector or any number of injectors that operate with parallel wiring with electronic fuel injectors.

It is appreciated that the present invention also can operate with diesel engines, Wankel or turbine engines that have spark plugs, computerized fuel injectors and its required components.

One reason that the inventive injected water outperforms conventional manifold methods is that water is delivered at a rate that is proportional to the fuel at all times. In the prior art methods, manifold absolute pressure dictated when water would be drawn in. Hence, on accelerations, manifold pressure would be negligible and no water would be introduced. On deceleration, when manifold pressure is high, the water flowed too rapidly. Only at steady state, when manifold pressure is uniform, is suitable water introduction achieved.

Figure 1:
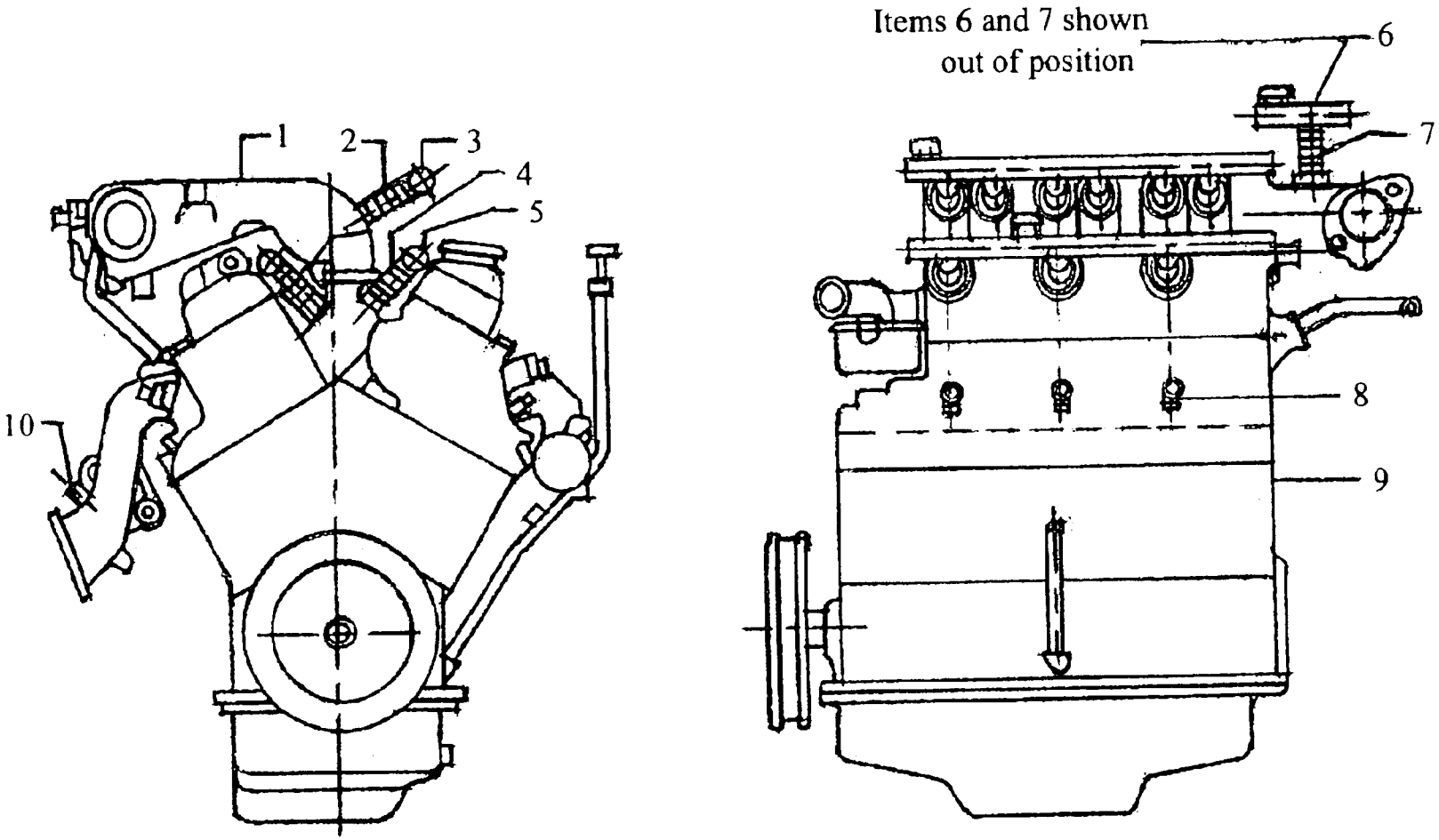
FIG. 1 is an exploded perspective view of an internal combustion engine equipped with the system of the present invention with certain components being shown schematically and with selected parts of the engine omitted for reasons of clarity.

Referring to FIG. 1, the front view of an internal combustion engine 9 shows intake manifold 1 in which are inserted water injectors 2 of the present invention. There is one water injector in combination with one fuel injector 4 and operates at the same time due to parallel circuitry coming from a power-train control module. The water rail 3 supplies water or an aqueous solution at a constant pressure coming from the electric constant pressure immersed pump in water tank. Fuel injectors 4 and fuel rail 5 are shown in present position of an internal combustion engine. Some engines have only one fuel injector. In side view, an internal combustion engine shows a single water injector 7 inserted into the intake manifold 1 which operates by a circuit coming from the power-train control module. The water rail 6 supplies water or a water solution at a constant pressure coming from the electric constant pressure immersed pump in water tank. Spark plugs 8 are shown in present position of an internal combustion engine. Input heated oxygen sensor 10 is only one of many sensors of an internal combustion engine feeding information into a power-train control module (PCM) to keep engine at a constant ratio of fuel and water or water solution to air in intake manifold. Present fuel injected internal combustion engine using all the equipped sensors, electric constant pressure immersed fuel pump, and power-train control module operates engine at a ratio of approximately 14.7 parts of air to 1 part of fuel. In a preferred embodiment, with the inventive injection system in place an engine still operates at the ratio of 14.7 parts air to 1 part of fuel plus water.

FIG. 1 also shows two methods of water injection. The first method uses only one injector 7, positioned after the throttle body and injecting water into the intake manifold. Injector operated by computer in power-train control modules. The second method used a water injector in conjunction with each fuel injector positioned in intake manifold above fuel injector. Water injector operated in unison with fuel injectors by parallel circuitry from power-train control module.

Figure 2:
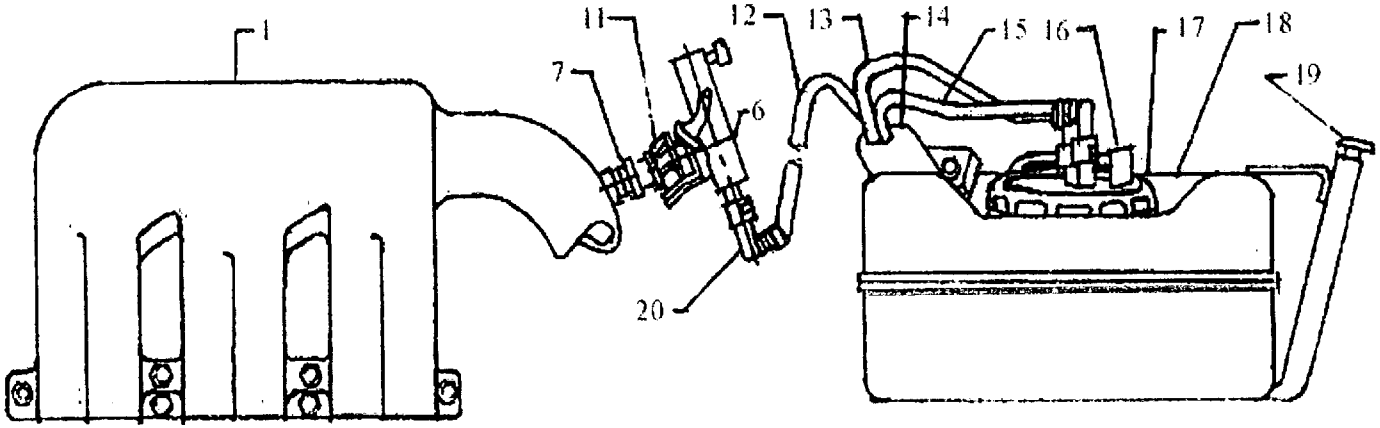
FIG. 2 is a system schematic configuration showing the usage of water or an aqueous solution from tank, an electric constant pressure immersed pump module in tank, a feed line from pump to a water rail with a single water injector inserted into intake manifold for a first inventive embodiment.

FIG. 2 shows intake manifold 1 having only one water injector 7 inserted into intake manifold 1 which is operated by a circuit coming from the power-train control module. Water injector 7 is operated by an electrical solenoid 11 at a precise engine stroke position and supplied with pressurized water or an aqueous solution from a water rail 6. Plastic quick connect fittings 20 and rubber water hose 12 supplies pressurized water or an aqueous solution from a water filter 14 to water rail 6. Rubber hose 13 is a return hose from filter to water pump module 16. Rubber hose 15 is a different size supply water hose from pump module 16 to filter 14. Water pump module 16 is secured to a plastic water tank 18 by a plastic lock nut 17. Vent type tank cap 19 used to keep foreign matter from entering water tank.

Figure 3:
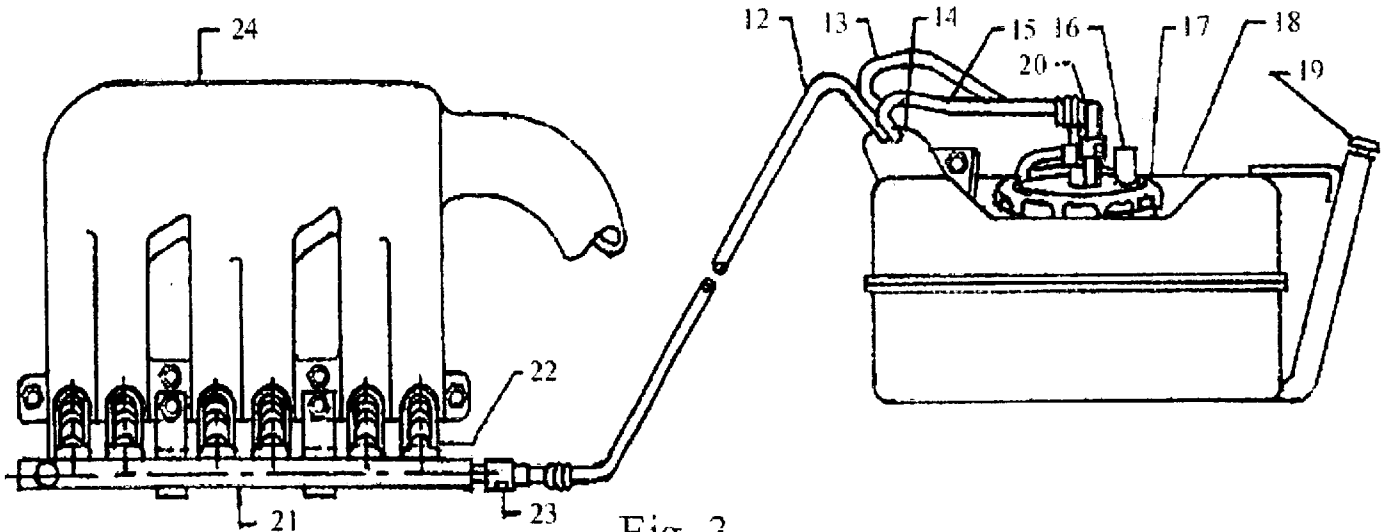
FIG. 3 is a system schematic configuration showing electric constant pressure immersed pump module in tank, a feed line from pump to a water rail and with a multiple of water injectors inserted into intake manifold for another inventive embodiment.

FIG. 3 is the same as FIG. 2 except there is a water injector 22 inserted into inlet manifold 24 for every fuel injector inserted into inlet manifold. Water rail 21 is also different due to a multiple number of injectors. A straight plastic quick connector is used to couple water rail 21 to rubber hose 12. The remainder of FIG. 3 is exactly the same as FIG. 2.

Figure 4:
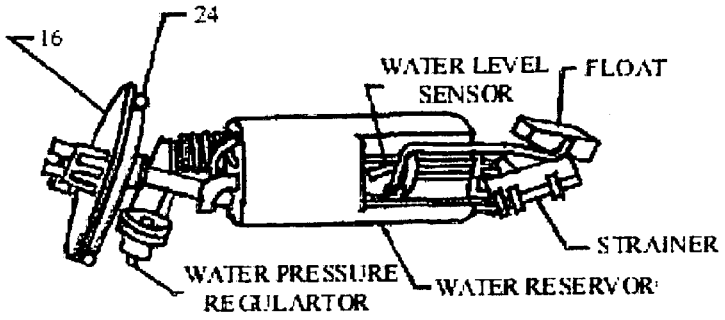
Fig. 4 PRIOR ART
FIG. 4 is a partial cutaway view of electric constant pressure immersed pump module that is installed into a water tank for the purpose of keeping a constant pressure of water in the water rail.

FIG. 4 is a purchased electric water pump module 16. It is a positive displacement, roller vane, immersed pump with a permanent magnet electric motor. The water pump module is suspended in the water of the water tank and sealed to tank with "O" ring 24. The pump draws water through a strainer and pushes it through the motor to the outlet. The pump preferentially contains two check valves. One valve relieves internal water pump pressure and regulates maximum pump output. The second valve, in the pump outlet, maintains pump pressure during engine off conditions. The regulator adjusts water system pressure. The water level sensor is attached to the side of the water pump module. The level sensor consists of a float, an arm, and a variable resister. As the water increases, the float and arm move up. This decreases the sending unit resistance, causing the water gauge on the instrument panel to read full.

Figure 5:
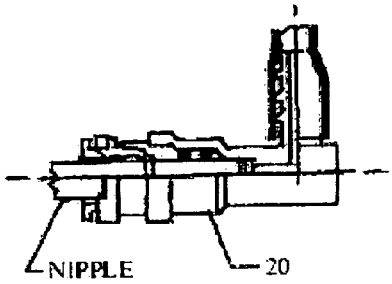
Fig. 5 PRIOR ART
FIG. 5 is a partial cutaway view of a 90° plastic quick connect fitting used to connect nipples at water pump module or water rail of FIG. 2 and water or aqueous solution feed line.

FIG. 5 is a conventional 90° plastic quick connect water fitting 20. The quick connect fitting consists of "O" rings that seal on nipples of water rail 6 and water pump module 16 as shown in FIG. 2 and FIG. 3. Also, the retainer locks the shoulder of the nipple in place. The water hoses are threaded onto the other end of the casings.

Figure 6:
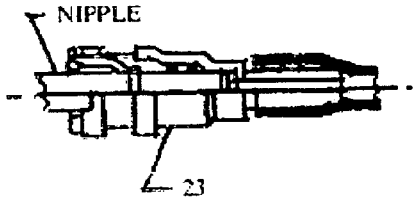
Fig. 6 PRIOR ART
FIG. 6 is a partial cutaway view of a straight plastic quick connect fitting used to connect nipple at water rail of FIG. 3 and water or water solution feed line.

FIG. 6 is a conventional straight plastic quick connect water fitting 23. Has the same components and same functions as fitting 20 except it is straight instead of 90°.

Figure 7:
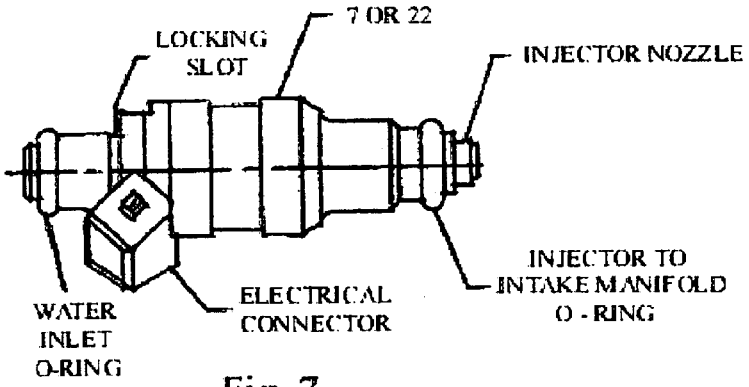
Fig. 7 PRIOR ART
FIG. 7 is a plan view of a water injector operated by an electrical solenoid.

FIG. 7 is a conventional water injector 7 or 22. It is electric solenoid operated by power-train control module at a precise timing controlled by engine stroke position, and computer in power-train control module. The differences between water injector 7 and water injector 22 are in the stroke of pintle that closes off an orifice at the nozzle end and the size of orifice at the nozzle end. These two items plus the pressure at the pressure regulator of water pump module 16 determines the pressure at the pressure regulator, the stroke of pintle and size of orifice at the timing when determining the ratio of fuel to water usage to obtain reduced hydrocarbons and carbon monoxide emissions.

Figure 8:
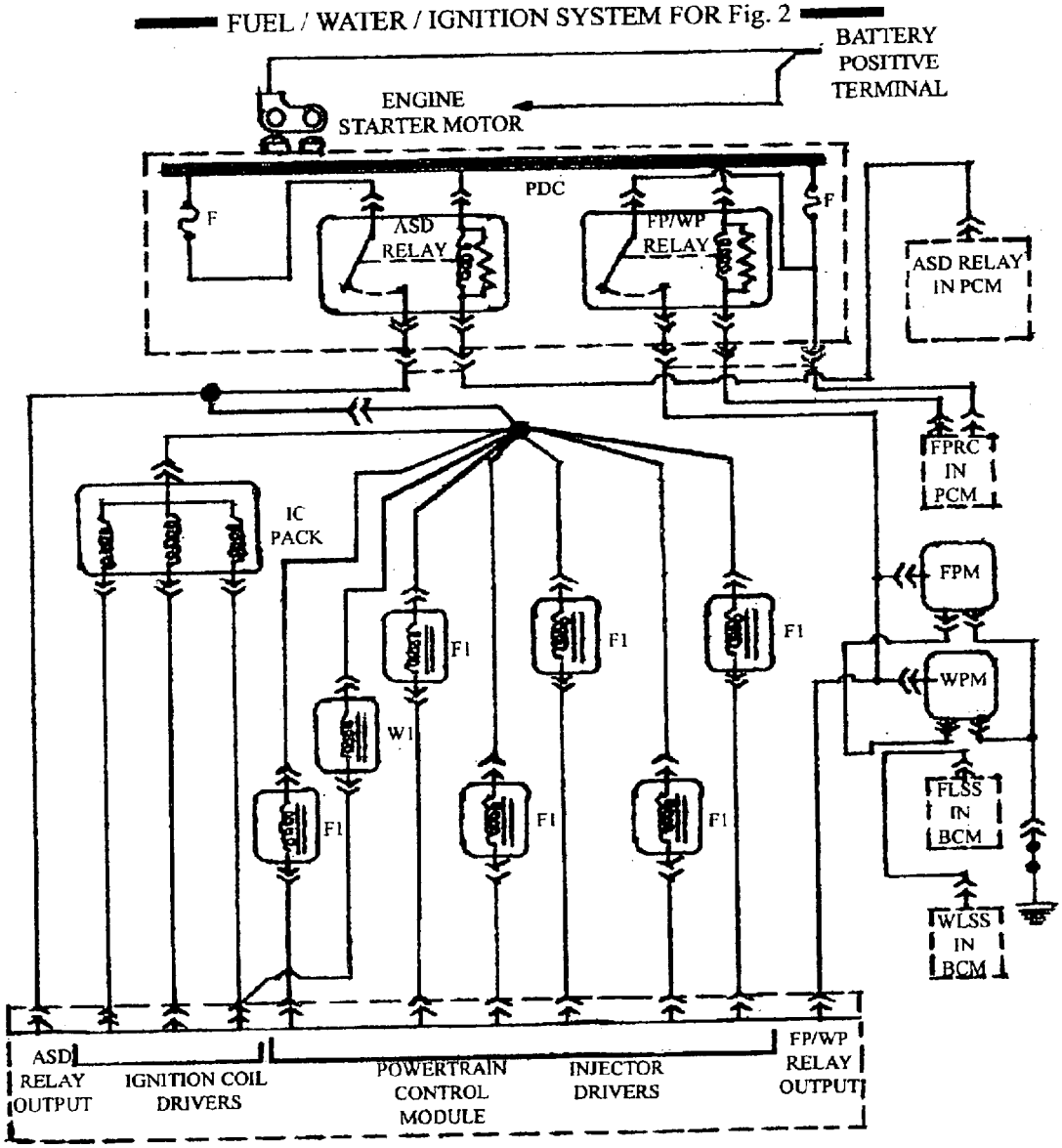
FIG. 8 is a schematic of the electrical fuel/water/ignition system for FIG. 2.

FIG. 8 is an electrical schematic diagram for fuel/water/ignition systems of FIG. 2. When ignition key is turned to start internal combustion engine, the power-train control module (PCM) receives the camshaft position sensor and crankshaft position sensor signals. It energizes the automatic shut down (ASD) relay and fuel/water pumps relay. These relays supply battery voltage to the fuel/water pumps, fuel/water injectors, ignition coil, and oxygen sensor heating element. The PCM energizes all injectors until it determines crankshaft position from the camshaft position sensor and crankshaft position sensor signals.

After determining crankshaft position, the PCM begins energizing the injectors in sequence. The PCM adjusts injector pulse width and controls injector synchronization by turning the individual ground paths to the injectors on and off. The PCM also adjusts ignition timing at engine idle, acceleration and deceleration modes and regulates the injectors' pulse widths to maintain better control of the air/fuel/water mixture as sensed through the inlet and outlet oxygen sensors. When ignition switch is turned to the off position, all outputs are turned off, no inputs are monitored and PCM shuts down.

This system of the invention uses only one water injector and is controlled on and off by PCM does not have the accuracy of fuel/water/air ratio of FIG. 2 as compared to FIG. 3 because water injector pulse width is not controlled by fuel injector pulse width as in FIG. 9.

FIG. 9 is an electrical schematic diagram for fuel/water/ignition systems of FIG. 3. It is similar in performance as FIG. 8 except for the following changes: There are multiple water injectors 22 operating in parallel circuitry with fuel injectors 5. If the PCM calls for a change in fuel injector pulse width, the same change in pulse width occurs in water injector which keeps the fuel to water exactly at the same ratio at all engine modes. Otherwise, all other operations as described in FIG. 8 are the same.

According to the present invention, fuel and water or an aqueous solution is introduced into an internal combustion engine chamber at a volume ratio of between 1:1 and 10:1. More preferably, the fuel:water volume ratio is 3:1 and 8:1. Still more preferably, the fuel:water volume ratio is 5:1 and 7:1. Most preferably, the fuel:water volume ratio is 5.5:1 and 6.5:1.

Solutes to water forming an aqueous solution according to the present invention illustratively include surfactants, organic and inorganic corrosion inhibitors, glycols and other antifreeze components, biocides, antiknock agents and combinations thereof. It is appreciated other conventional water soluble additives are also operative herein to maintain the flow properties of water under a variety of temperature conditions, prevent biologic colonization of the water tank and inhibit cylinder corrosion.

In another embodiment, a closed loop water system is utilized where steam condensate from the exhaust manifold or other exhaust system component is used to replenish the water tank. Since fuel combustion generates excess water relative to the water injection fraction, only a portion of the condensate need be recycled. In a closed loop water system, solutes are added by way of a diffusion limited time release capsule as detailed in U.S. Pat. No. 4,235,988.

It is appreciated that the inventive fluid injection system is readily coupled to a variety of combustion engines. Operative engines with the instant invention illustratively include internal combustion, diesel, Wankel, and gas turbine.

EXAMPLE 1

Emission Testing.

A "Bear gas analysis system 4", to record a benchmark, both with and without electronic control water injection. A 1999 Chrysler minivan having a 3.8 liter, 6 cylinder engine was used as a test vehicle equipped with an automatic transmission and air conditioning (A/C). The first test was with fuel only. The readings were:

| RPM | Hydrocarbons | Carbon Monoxide | Carbon Dioxide |
|---|---|---|---|
| 2000 | 23 ppm | 0.05% | 12% |
| 1000 | 35 ppm | 0.05% | 13% |

A fuel mixture of 6 parts of fuel to one part of water by volume was tested in the vehicle. The readings were:

| RPM | Hydrocarbons | Carbon Monoxide | Carbon Dioxide |
|---|---|---|---|
| 2000 | 0.00 ppm | 0.00% | 20.00% |
| 1000 | 0.00 ppm | 0.00% | 20.00% |

EXAMPLE 2

A 92 mile round trip test was run with the test vehicle of Examples 1 and 2 with A/C in use. Twenty miles of city driving and 72 miles of expressway. Stop and go due to traffic lights in city and driving 65 miles per hour on the expressway. The route was driven twice under similar conditions, once with fuel only and once with fuel and water injection at a 6 to 1 volume ratio. The results for the expressway portion were:

| Fuel Only Miles/Gallon | Fuel and Water Miles/Gallon |
|---|---|
| 18.41 | 25.01 |

The results for city driving were:

| Fuel Only Miles/Gallon | Fuel and Water Miles/Gallon |
|---|---|
| 14.97 | 17.92 |

After driving 2794 miles using the fuel and water mixture, the spark plugs were visibly cleaner and devoice of previous carbon deposits.

What is claimed is:

1. An engine fluid injection system comprising:

a fluid rail;

a tube in fluid communication with said rail;

a fluid injector receiving a fluid from said fluid rail through said tube, said fluid injector inserted into an internal combustion engine intake manifold; and a power train control module operating to maintain a preselected fuel to fluid ratio comprising parallel wiring between said fluid injector and an electronic fuel injector.

2. The engine fluid injection system of claim 1 wherein the fuel to fluid ratio is between 1:1 and 10:1.

3. The engine fluid injection system of claim 1 wherein the fuel to fluid ratio is between 3:1 and 8:1.

4. The engine fluid injection system of claim 1 wherein the fuel to fluid ratio is between 5:1 and 7:1.

5. The engine fluid injection system of claim 1 wherein said rail supplies the fluid at a constant pressure to said fluid injector.

6. The engine fluid injection system of claim 5 further comprising an electric constant pressure pump to supply the fluid at the constant pressure.

7. The engine fluid injection system of claim 1 further comprising a solenoid operating said fluid injector.

8. The engine fluid injection system of claim 1 wherein said fluid is selected from a group consisting of water and an aqueous solution.

9. The engine fluid injection system of claim 1 further comprising a plurality of said fluid injectors wherein each of said plurality of fluid injectors is coupled to said fuel injector of said manifold.

10. The engine fluid injection system of claim 9 wherein each of said plurality of fluid injectors is coupled to one of a plurality of said fuel injectors.

11. The engine fluid injection system of claim 1 further comprising a steam condensate system coupled to an exhaust system of an engine to return condensate to said fluid rail.

12. The engine fluid injection system of claim 1 wherein said manifold is coupled to an internal combustion engine.

13. The engine fluid injection system of claim 1 wherein said manifold is coupled to a diesel engine.

14. The engine fluid injection system of claim 1 wherein said manifold is coupled to a Wankel internal combustion engine.

15. The engine fluid injection system of claim 1 wherein said manifold is coupled to a turbine engine.

* * * * *